US011959721B2

(12) United States Patent
Kam

(10) Patent No.: US 11,959,721 B2
(45) Date of Patent: Apr. 16, 2024

(54) PNEUMATIC POP GUN LAUNCHER WITH OPPOSING LEVERED HANDLES

(71) Applicant: Ao Jie Plastic Toys Factory Ltd., Kwun Tong (HK)

(72) Inventor: Chi Hang Kam, Kwun Tong (HK)

(73) Assignee: Ao Jie Plastic Toys Factory Ltd., Kwun Tong (HK)

( * ) Notice: Subject to any disclaimer, the term of this patent is extended or adjusted under 35 U.S.C. 154(b) by 0 days.

(21) Appl. No.: 17/823,511

(22) Filed: Aug. 30, 2022

(65) Prior Publication Data

US 2024/0068768 A1 Feb. 29, 2024

(51) Int. Cl.
*F41B 11/683* (2013.01)
*F41B 11/89* (2013.01)

(52) U.S. Cl.
CPC ..... *F41B 11/683* (2013.01); *F41B 11/89* (2013.01)

(58) Field of Classification Search
CPC ..... F41B 11/683; F41B 11/684; F41B 11/89
USPC ..... 124/63–67
See application file for complete search history.

(56) References Cited

U.S. PATENT DOCUMENTS 1,045,373 A * 11/1912 Cook ..... F41B 11/68 124/67
2,069,821 A 2/1937 Douglas
2,214,224 A 9/1940 Douglas
2,237,678 A * 4/1941 Lohr ..... F41B 11/642 124/66
2,306,668 A * 12/1942 Stevens ..... F41B 11/648 124/67
2,630,795 A * 3/1953 Peters ..... F41B 11/642 124/67
2,652,821 A * 9/1953 Fitch ..... F41B 11/62 124/75
3,957,027 A 5/1976 Drake
4,086,901 A 5/1978 Clement
4,625,706 A 12/1986 Turner, Jr.
4,928,661 A * 5/1990 Bordt ..... F41B 11/683 124/80
D337,796 S 7/1993 Sutyak
5,224,464 A 7/1993 Burnham et al.
5,242,323 A 9/1993 Rappaport
5,253,873 A 10/1993 Grattan
5,535,729 A * 7/1996 Griffin ..... F41B 11/64 124/66

(Continued)

*Primary Examiner* — Bret Hayes
(74) *Attorney, Agent, or Firm* — LaMorte & Associates P.C.

(57) ABSTRACT

A manually operated toy pneumatic launcher for launching a ball projectile. The pneumatic launcher has a housing with a first section and a second section that move relative to each other. At least one handle extends from the second section that rotates through a range of motion. A base tube is affixed to the second section. A launch tube is affixed to the first section. The launch tube extends into the base tube creating a telescoping tube assembly. A mechanism is provided that is powered by the handle moving through its range of motion. The mechanism includes a gear box, a lever arm, and a slide that act together to linearly move the first section of the housing relative to the second section. This selectively changes the length of the telescoping tube assembly, therein enabling the telescoping assembly to compress and release air in the launching of the projectile.

18 Claims, 5 Drawing Sheets

(56) References Cited

U.S. PATENT DOCUMENTS

| | | | | | |
|---|---|---|---|---|---|
| 5,660,159 | A * | 8/1997 | Clayton | F41B 11/646 | 124/66 |
| 5,678,528 | A | 10/1997 | Hadley | | |
| 5,701,879 | A * | 12/1997 | Johnson | F41B 11/681 | 124/63 |
| 5,711,284 | A | 1/1998 | Keenan, Jr. | | |
| 6,067,975 | A * | 5/2000 | Ginn | F41B 11/89 | 124/66 |
| 6,076,513 | A | 6/2000 | Doherty et al. | | |
| 6,499,478 | B1 | 12/2002 | Perez | | |
| 6,997,770 | B2 | 2/2006 | Lapointe | | |
| 7,730,881 | B1 * | 6/2010 | Pedicini | F04B 35/04 | 124/65 |
| 8,485,171 | B2 | 7/2013 | Romney | | |
| 8,505,524 | B2 | 8/2013 | Lyon | | |
| 8,671,926 | B1 * | 3/2014 | Mahlstedt | F41B 11/89 | 124/65 |
| 8,991,374 | B1 | 3/2015 | Conkel | | |
| 9,261,322 | B1 | 2/2016 | Conkel | | |
| 9,341,422 | B2 | 5/2016 | Rodich et al. | | |
| 9,513,075 | B2 | 12/2016 | Lallier et al. | | |
| D832,370 | S | 10/2018 | Chen | | |
| D832,939 | S | 11/2018 | Chen | | |
| D946,090 | S | 3/2022 | Wang | | |
| D948,633 | S | 4/2022 | Kam | | |
| 11,325,051 | B1 | 5/2022 | Hill | | |
| D954,890 | S | 6/2022 | Zhang | | |
| 2007/0193571 | A1 | 8/2007 | Moss | | |
| 2009/0050128 | A1 | 2/2009 | Mitchell | | |
| 2009/0145412 | A1 * | 6/2009 | Barish | F41B 11/89 | 124/1 |
| 2015/0059720 | A1 | 3/2015 | Barber | | |

* cited by examiner

PNEUMATIC POP GUN LAUNCHER WITH OPPOSING LEVERED HANDLES

BACKGROUND OF THE INVENTION

1. Field of the Invention

In general, the present invention relates to the structure of pneumatic launchers that are specifically designed to launch ball projectiles. More particularly, the present invention relates to launchers with mechanisms that convert non-linear motion of components into linear motion that creates pressurized air within a launcher.

2. Prior Art Description

Toy projectile launchers in the form of toy guns, toy bows, and the like have existed for centuries. Toy projectile launchers utilize a variety of mechanisms to launch projectiles into flight. For example, a toy bow and arrow would typically use a string to launch an arrow into flight. A toy dart gun would typically use a compressed spring to launch a toy dart into flight. If the toy projectile is a lightweight ball, such as a foam ball or cork ball, pneumatics are typically used to launch the projectile into flight. Such pneumatic launchers are traditionally called pop guns in the toy industry due to the popping sound produced when the projectile is launched. In a pop gun, a ball projectile is typically positioned at the end of a tube. A piston is then moved in the tube, or the tube is compressed, to create pneumatic pressure. The pneumatic pressure forces the ball projectile out of the tube with enough velocity for the toy ball to fly toward a target.

In many pop gun designs, the air compression is created by manually forcing a piston through a tube or collapsing a telescoping tube. Accordingly, the functionality utilized by the toy governs much of the design of the toy. That is, a long tube must be provided with handles to manipulate the tube. The handles provided may have different shapes, but the pop gun tends to have the general elongated appearance of a tube. This may not be desirable. Such prior art pop guns are exemplified by U.S. Pat. No. D832,370 to Chen and U.S. Pat. No. D832,939 to Chen.

Another disadvantage of traditional pop guns is that the pneumatic force used to launch the projectile is highly dependent upon the strength of the child using the pop gun. The pneumatic force is directly proportional to the manual force applied to the pop gun. There is no mechanism that provides some mechanical advantage to increase the forces being applied. Accordingly, strong children can launch projectiles faster and farther than other children. This can detract from the play value of the toy since the toy does not perform the same for all children.

A need therefore exists for a new pop gun design that enables the pop gun to be configured in new and interesting ways that do not necessarily resemble an elongated tube. Likewise, a need exists for a new pop gun design that has an applied mechanical advantage to the launching of projectiles, therein making the toy gun consistent for all users. These needs are met by the present invention as described and claimed below.

SUMMARY OF THE INVENTION

The present invention is a manually operated toy pneumatic launcher for launching a ball projectile. The pneumatic launcher has a housing with a first section and a second section that move relative to each other. At least one handle extends from the second section, wherein the handle is free to rotate through a range of motion.

A base tube is affixed to the second section of the housing. A launch tube is affixed to the first section of the housing. The launch tube extends into the base tube creating a telescoping tube assembly of a changeable length.

A mechanism is provided that is powered by the handle moving through its range of motion. The mechanism includes a gear box, a lever arm and a slide that act together to linearly move the first section of the housing relative to the second section. This selectively changes the length of the telescoping tube assembly, therein enabling the telescoping assembly to draw, compress and release air in the launching of the projectile ball.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention pneumatic launcher can be embodied in many ways, only one exemplary embodiment is illustrated. The exemplary embodiment is shown for the purposes of explanation and description. The exemplary embodiment is selected in order to set forth one of the best modes contemplated for the invention. The illustrated embodiment, however, is merely exemplary and should not be considered a limitation when interpreting the scope of the appended claims.

Figure 1:
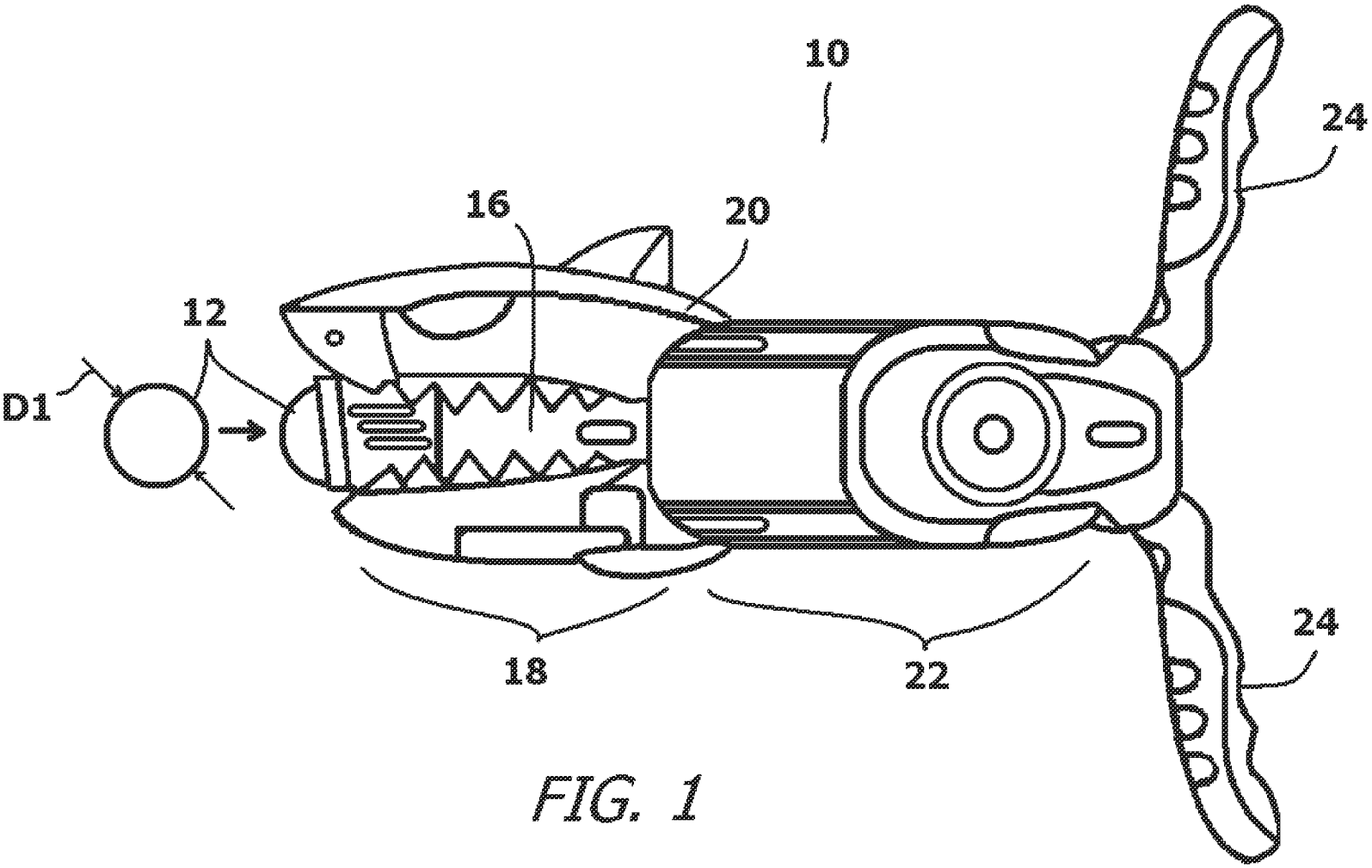
FIG. 1 is a side view of an exemplary embodiment of a pneumatic launcher shown in a first configuration prior to firing.
Figure 2:
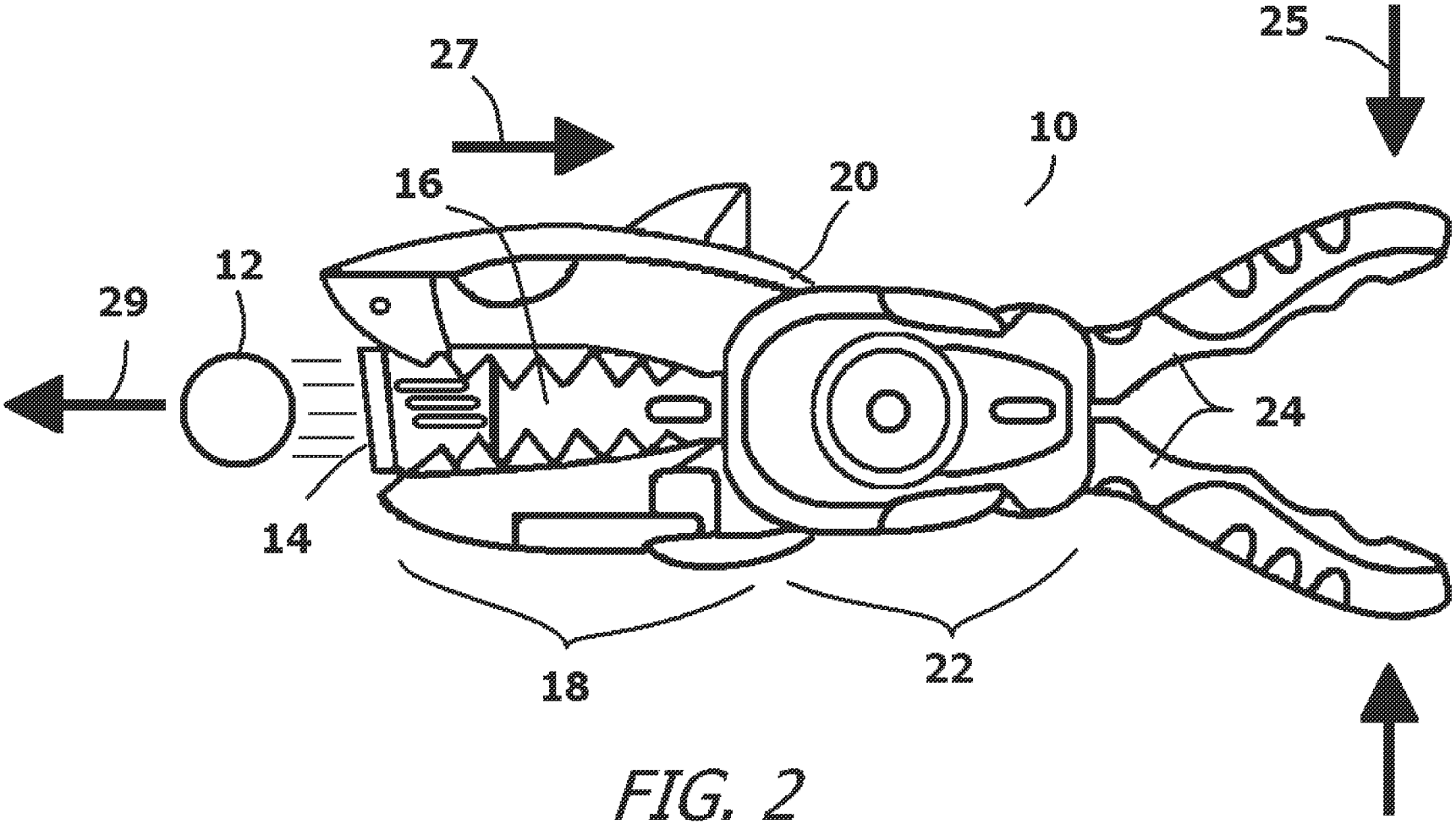
FIG. 2 is side view of an exemplary embodiment of a pneumatic launcher shown in a second configuration after firing.

Referring to FIG. 1 and FIG. 2, a pneumatic launcher 10 is shown. The pneumatic launcher 10 launches ball projectiles 12 that have a first diameter D1. The pneumatic launcher 10 has an internal launching mechanism that launches the ball projectiles 12 from a discharge end 14 of a launch tube 16. The internal launching mechanism is embodied inside a decorative shell 20. The decorative shell 20 shown has a shark motif. However, other animal and object motifs can be used by altering the shape and graphics of the decorative shell 20. The decorative shell 20 has a head section 18, a body section 22, and diverging handles 24. The diverging handles 24 can have the general appearance of tail fins, legs or arms depending upon the selected motif. As will be explained, when the diverging handles 24 are manually moved toward each other in the directions of arrow 25, the head section 18 of the decorative shell 20 moves toward the body section 22 in the direction of arrow 27. This lateral movement of the head section 18 toward the body section 22 is used to compress a volume of air. Once compressed to a pressure above a triggering pressure, the compressed air launches the ball projectile 12 out of the launch tube 16 in the direction of arrow 29.

Figure 3:
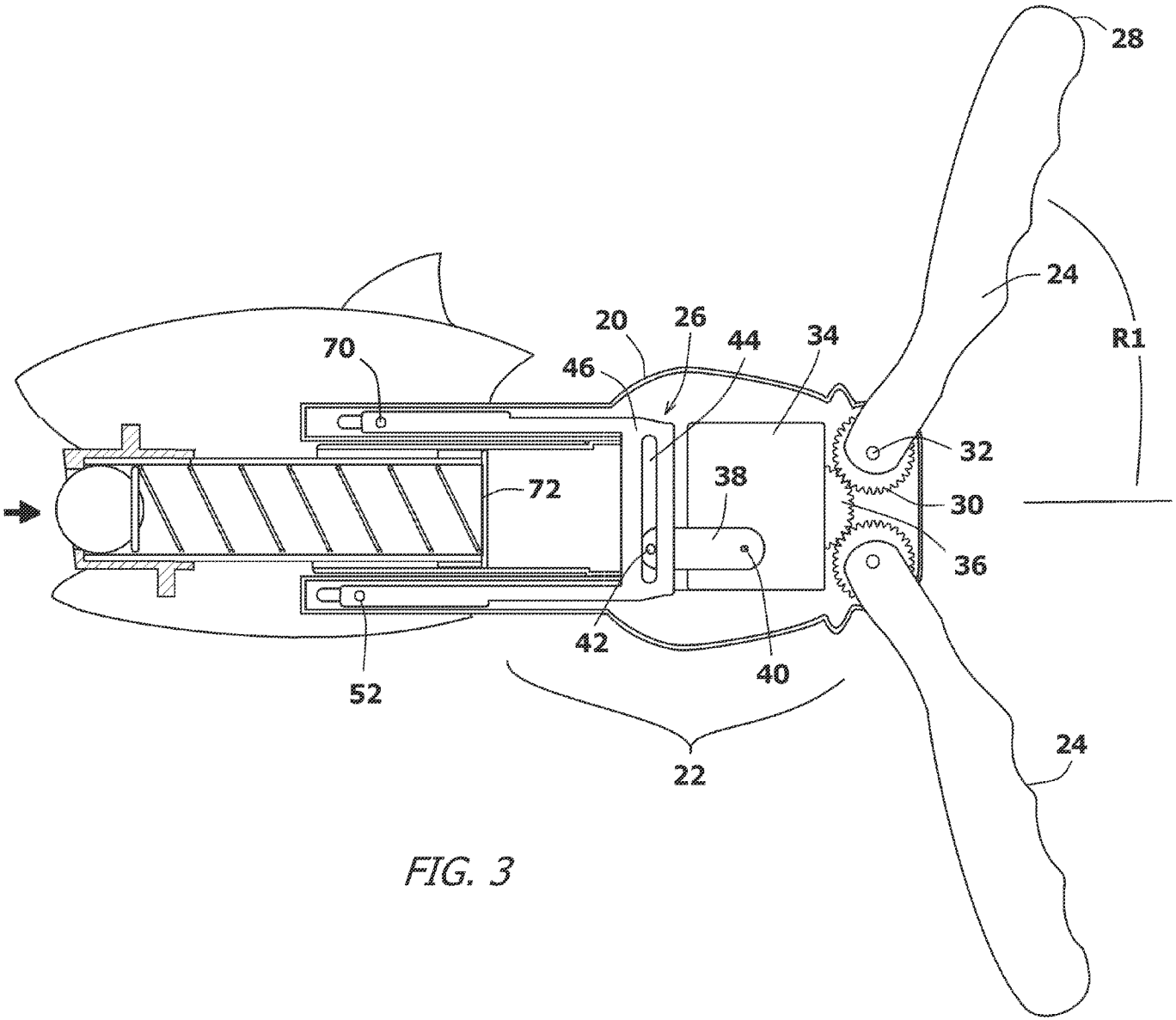
FIG. 3 is a cross-sectional view of the exemplary embodiment of FIG. 1, shown in conjunction with a ball projectile.
Figure 4:
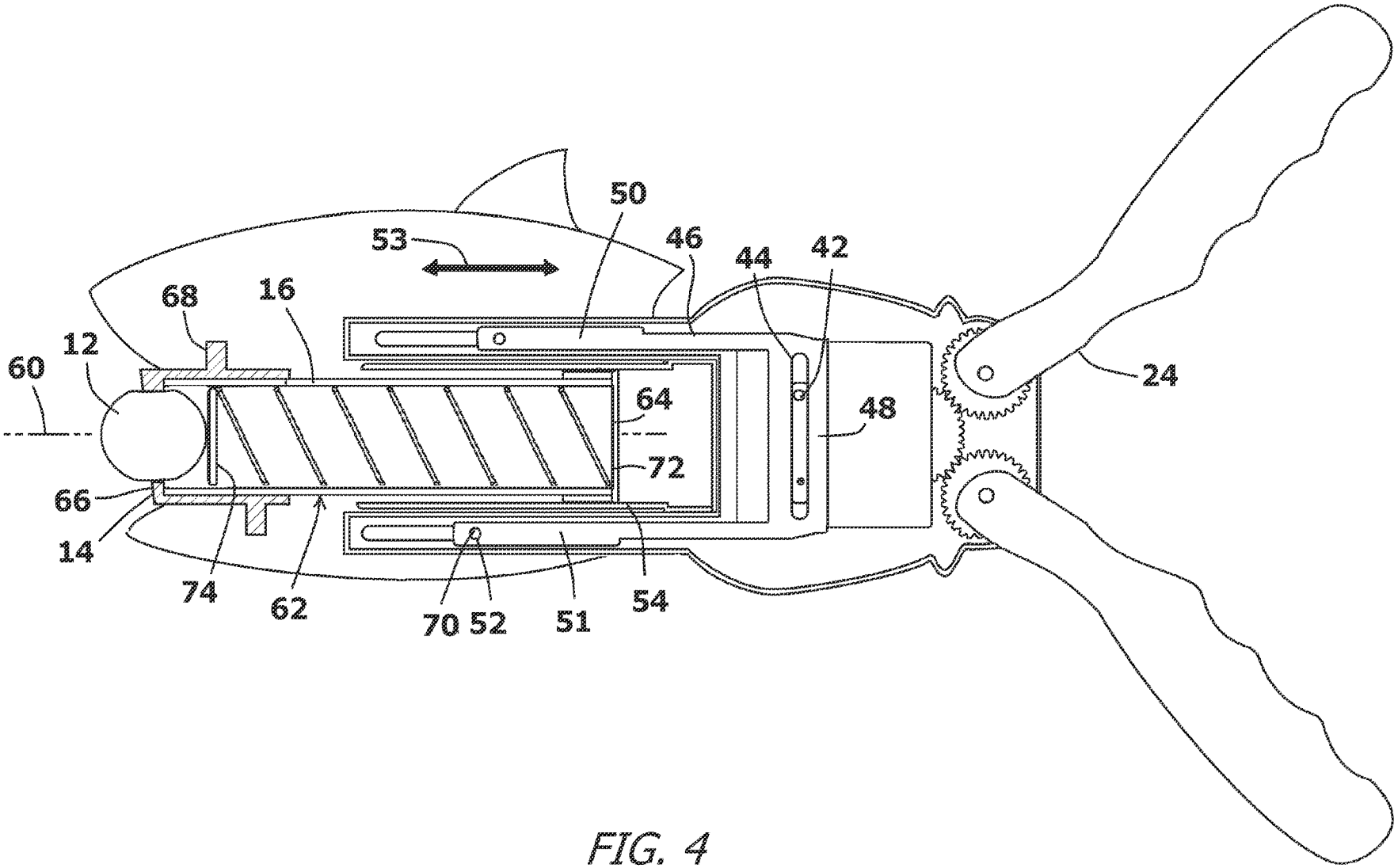
FIG. 4 is a cross-sectional view of the exemplary embodiment transitioning between the configuration of FIG. 1 and the configuration of FIG. 2.
Figure 5:
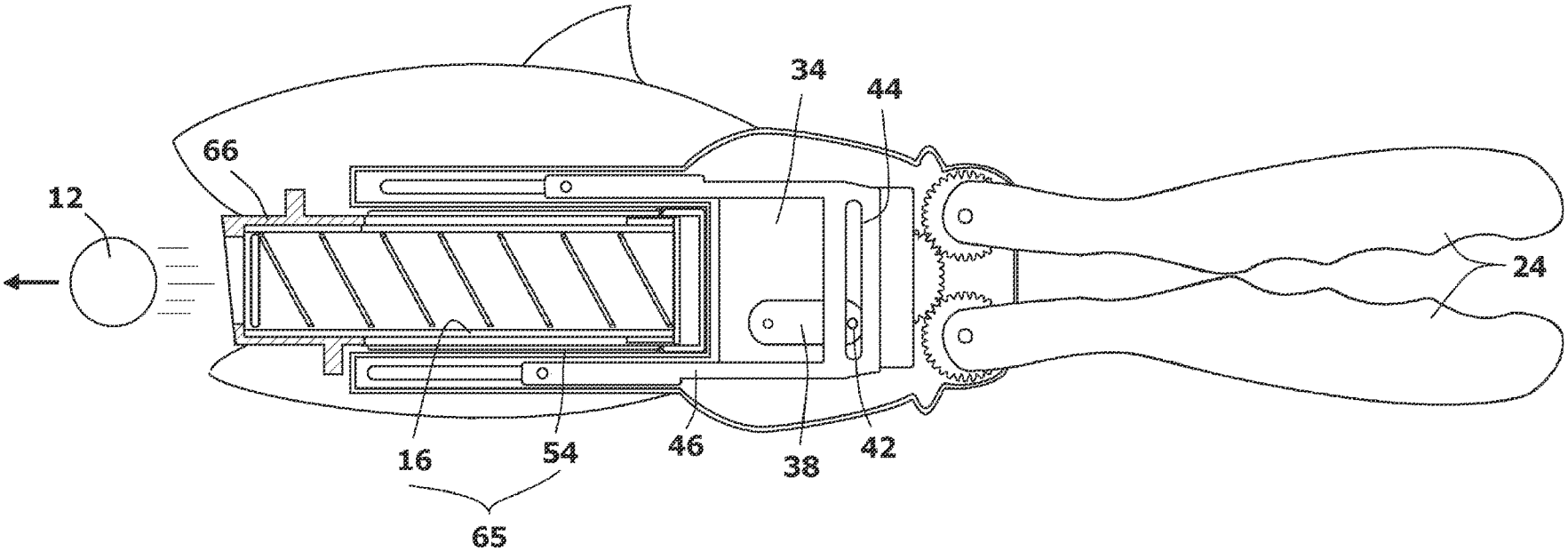
FIG. 5 is a cross-sectional view of the exemplary embodiment of FIG. 2, shown in conjunction with a ball projectile.

Referring to FIG. 3, FIG. 4, and FIG. 5 in conjunction with FIG. 1 and FIG. 2, the details of the internal launching mechanism 26 are described. Each of the diverging handles 24 have a free end 28 that extends out of the body section 22 of the decorative shell 20 and a second end that extends into the body section 22 of the decorative shell 20. The second end of each of the diverging handles 24 terminates with a gear head 30. The diverging handles 24 are affixed to the body section 22 via pivot pins 32 that pass through the centers of the gear heads 30. This enables the diverging handles 24 to rotate about the pivot pins 32 as the gear heads 30 rotate about the pivot pins 32. The gear heads 30 on the diverging handles 24 enable the diverging handles 24 to rotate through a range R1 from the open configuration of FIG. 3 to the closed configuration of FIG. 5. In the open configuration, the diverging handles 24 may diverge at any angle from 80 degrees to 140 degrees. In the closed configuration, the diverging handles 24 approach parallel.

A gear box 34 is provided inside the body section 22. The gear box 34 has a pinion gear 36 that is engaged simultaneously by both the gear heads 30. Accordingly, when the diverging handles 24 are rotated about the pivot pins 32 through the range R1, the gear heads 30 rotate and the rotational energy is transferred directly to the pinion gear 36 of the gear box 34. The diverging handles 24 are long and provide significant torque to the pinion gear 36. This mechanical advantage causes the pinion gear 36 to rotate rapidly when only light forces are applied to the diverging handles 24. The result is that the strength of the person squeezing the diverging handles 24 together has little effect on the operation of the pneumatic launcher 10.

A lever arm 38 is provided on the exterior of the gear box 34. The lever arm 38 is affixed to a shaft 40 that is turned by the gear box 34. When the diverging handles 24 are in their open configuration, the gear box 34 rotates the lever arm 38 to face away from the diverging handles 24. See FIG. 3. When the diverging handles 24 are in their closed configuration, the gear box 34 rotates the lever arm near 180 degrees to face toward the diverging handles 24. See FIG. 5. There are many gear configurations that can be used in the gear box 34 to convert the rotational movement of the pinion gear 36 to the described rotational movement of the lever arm 38. Any such gear configuration can be adapted for use in this invention.

A cam pin 42 extends from the lever arm 38. The cam pin 42 engages a cam slot 44 in the base of a U-shaped slider 46. The U-shaped slider 46 has a base 48 and two extender arms 50, 51 that extend in parallel at right angles to the base 48. As the lever arm 38 rotates, the cam pin 42 moves in the cam slot 44 and the rotational movement is converted into linear movement. Accordingly, the two extender arms 50, 51 move back and forth in the directions of arrow 53 as the diverging handles 24 power the gear box 34 and the gear box 34 moves the lever arm 38. Mounting holes 52 are formed in the extender arms 50, 51 for a purpose that is later explained.

A base tube 54 is attached to the body section 22. The base tube 54 is a hollow tube having an open end 56 and a closed end 58. The base tube 54 is disposed about a central axis 60, wherein the central axis 60 is parallel to the direction of movement of the extender arms 50, 51 on the U-shaped slider 46. The base tube 54 is attached to the body section 22. Accordingly, when the U-shaped slider 46 is moved by the lever arm 38, the extender arms 50, 51 of the U-shaped slider 46 move in parallel to the central axis 60 of the base tube 54 both above and below the base tube 54.

A plunger assembly 62 is provided. The plunger assembly 62 contains the launch tube 16. The launch tube 16 has its discharge end 14 and an open second end 64 that passes into the open end 56 of the base tube 54. The launch tube 16 has an outside diameter that is smaller than the inside diameter of the base tube 54. The launch tube 16 also has an inside diameter that is larger than that of the ball projectiles 12. The discharge end 14 of the launch tube 16 contains a restriction 66 that restricts the discharge end 14. The restriction 66 is preferably resilient and is slightly smaller than the diameter of the ball projectiles 12. However, due to the materials used to make the restriction 66 and the ball projectiles 12, the ball projectiles 12 can be forced through the restriction 66 if biased with sufficient force. A mount 68 is also attached to the exterior of the launch tube 16 near its discharge end 14. The mount 68 connects the launch tube 16 to the head section 18 of the decorative shell 20. In this manner, the launch tube 16 and the head section 18 move in unison as a single piece.

The head section 18 of the decorative shell 20 has posts 70 that extend into the mounting holes 52 in the extender arms 50, 51 of the U-shaped slider 46. In this manner, any lateral movement of the extender arms 50, 51 in the direction of arrow 53 is directly transferred to the head section 18 and the launch tube 16. It will therefore be understood that by moving the diverging handles 24 through their range of movement, the head section 18 and launch tube 16 move laterally relative to the body section 22 and the base tube 54.

A seal 72 is attached to the launch tube 16 near its second end 64. The seal 72 and the second end 64 of the launch tube 16 pass into the open end 56 of the base tube 54. Accordingly, the launch tube 16 and the base tube 54 create a larger telescoping tube assembly 65 of a first length. The length of the telescoping tube assembly 65 changes as the launch tube 16 moves within the base tube 54.

One or more ball projectiles 12 are inserted into the launch tube 16 through the restriction 66 at the discharge end 14 of the launch tube 16. Once in the launch tube 16, the ball projectile 12 is biased against the restriction 66 by an annular spring head 74 and spring 76. As the ball projectile 12 is biased against the restriction 66, the ball projectile 12 seals the discharge end 14 of the launch tube 16 and the pneumatic launcher 10 is ready to fire.

Referring to FIG. 4 and FIG. 5, it can be seen that once the ball projectile 12 is in the launch tube 16, the diverging handles 24 can be manually rotated toward each other. This manual movement is transferred to the gear box 34. The gear box 34 transfers the movement to the lever arm 38. The lever arm 38 rotates and moves the cam pin 42 through the cam slot 44 in the U-shaped slider 46. The U-shaped slider 46 moves laterally in the direction of the diverging handles 24. The U-shaped slider 46 is attached to the head section 18 and the launch tube 16. Accordingly, the launch tube 16 moves in the direction of the diverging handles 24. The launch tube 16 and the base tube 54 form a telescoping tube assembly 65. As the launch tube 16 advances into the base tube 54, the air in the telescoping tube assembly 65 is trapped behind the ball projectile 12. As the launch tube 16 advances in the base tube 54, the length of the telescoping tube assembly 65 shortens and the trapped air is compressed. The result is that the pressure of the trapped air increases. The compressed air acts upon the ball projectile 12. Eventually, the pressure becomes great enough to force the ball projectile 12 through the restriction 66. Once forced through the restriction 66, the pressure is released and the ball projectile 12 is thrown into flight.

It will be understood that the embodiments of the present invention that is illustrated and described is merely exemplary and that a person skilled in the art can make many variations to that embodiment. For instance, the shark motif can be changed to other animals and objects. All such embodiments are intended to be included within the scope of the present invention as defined by the claims.

What is claimed is:

1. A toy pneumatic launcher for launching a ball projectile, comprising:

a first section;

a second section;

a handle extending from said second section, wherein said handle is free to rotate relative to said second section through a range of motion;

a gear box powered by said handle as said handle is moved through said range of motion, wherein said gear box rotates a lever;

a base tube affixed to said second section;

a launch tube affixed to said first section, wherein said launch tube extends into said base tube creating a telescoping tube assembly of a first length;

wherein said lever linearly moves said first section relative to said second section as said lever is moved by said gear box, therein selectively changing said first length of said telescoping tube assembly.

2. The launcher according to claim 1, wherein said handle terminates with a gear head that engages and powers said gear box when said at least one handle moves through said range of motion.

3. The launcher according to claim 2, wherein said gear box is anchored to said second section.

4. The launcher according to claim 2, wherein said gear box rotates said lever from a first position to a second position as said handle moves through said range of motion.

5. The launcher according to claim 4, further including a slide that is moved by said lever, wherein said slide moves linearly as said lever rotates between said first position and said second position.

6. The launcher according to claim 5, wherein said slide is affixed to said first section and causes said first section to move linearly as said slide moves linearly.

7. The launcher according to claim 1, wherein said first section and said second section are housing sections with external surfaces that are shaped to a common motif.

8. The launcher according to claim 1, wherein said launch tube has a dispensing end and a restriction proximate said dispensing end.

9. The launcher according to claim 8, wherein a ball projectile can be advanced into said launch tube past said restriction.

10. The launcher according to claim 9, further including a spring in said launch tube for biasing any ball projectile in said launch tube against said restriction.

11. A toy pneumatic launcher for launching a projectile, comprising:

a first housing section;

a second housing section;

a handle extending from said second housing section, wherein said handle can move through a range of motion;

a telescoping tube assembly affixed to said first housing section and said second housing section;

gears set into motion by said handle moving through said range of motion;

a lever, moved by said gears, that moves said first section relative to said second section, therein selectively compressing and elongating said telescoping tube assembly.

12. The launcher according to claim 11, wherein said gears are part of a gear box and said handle terminates with a gear head and powers said gear box when said handle is moved through said range of motion.

13. The launcher according to claim 12, wherein said gear box is disposed in said second housing section.

14. The launcher according to claim 13, wherein said gear box rotates said lever from a first position to a second position as said handle moves through said range of motion.

15. The launcher according to claim 14, further including a slide that is moved by said lever, wherein said slide moves linearly as said lever rotates between said first position and said second position.

16. The launcher according to claim 15, wherein said slide is affixed to said first housing section and causes said first housing section to move linearly as said slide moves linearly.

17. The launcher according to claim 11, wherein said first housing section and said second housing section have external surfaces that are shaped to a common motif.

18. A toy pneumatic launcher for launching a projectile, comprising:

a telescoping tube assembly having a launch tube and a base tube;

a slide for selectively moving said launch tube within said base tube;

a lever arm for moving said slide;

a gear box for moving said lever arm; and a handle for manually powering said gear box.

* * * * *